US007338362B1

(12) United States Patent
Gallagher

(10) Patent No.: US 7,338,362 B1
(45) Date of Patent: Mar. 4, 2008

(54) CARD GAME

(76) Inventor: Thomas B. Gallagher, 520 Pine Ave. #4, Goleta, CA (US) 93117

( * ) Notice: Subject to any disclaimer, the term of this patent is extended or adjusted under 35 U.S.C. 154(b) by 658 days.

(21) Appl. No.: 10/627,528

(22) Filed: Jul. 25, 2003

(51) Int. Cl.
*A63F 9/24* (2006.01)

(52) U.S. Cl. ..... 463/13; 273/292

(58) Field of Classification Search ..... 273/292; 463/9, 12–13
See application file for complete search history.

(56) References Cited

U.S. PATENT DOCUMENTS 5,224,706 A 7/1993 Bridgeman et al.
5,275,415 A 1/1994 Wisted
5,288,082 A 2/1994 Marquez
5,366,228 A 11/1994 Kangsanaraks
5,374,067 A 12/1994 Jones
5,613,682 A 3/1997 Otuzbiryan
5,782,473 A 7/1998 Chou et al.
5,785,606 A 7/1998 Marquez
2003/0057648 A1* 3/2003 Webb ..... 273/292
2003/0184015 A1* 10/2003 Williams ..... 273/292
2004/0092301 A1* 5/2004 Williams ..... 463/16

* cited by examiner

*Primary Examiner*—Robert E. Pezzuto
*Assistant Examiner*—Alex F. R. P. Rada, II
(74) *Attorney, Agent, or Firm*—Rob L. Phillips; Greenberg Traurig

(57) ABSTRACT

A wagering card game using a standard deck of playing cards with an objective of achieving a total hand value nearest to thirty-three (33) without going over is disclosed. Players play against a dealer in an attempt to reach a total hand value greater than the dealer but less than thirty-three (33). Players are limited to receiving a maximum number of cards (e.g., five cards). In addition, a side wager provides players with an opportunity to win large payouts. The side wager is dependent upon the initial three cards received by the player. A pay table associated with the side wager comprises payouts for flushes, straights, straight flushes and threes of a kind. In one embodiment of the game, a game table incorporates a display for tracking the players' and dealer's total hand values. In another embodiment, play of the game is facilitated by an electronic gaming machine.

22 Claims, 4 Drawing Sheets

| HAND TYPE | PAY TABLE A | PAY TABLE B | PAY TABLE C |
|---|---|---|---|
| THREE 3s | 200 | 200 | 200 |
| THREE OF A KIND | 50 | 50 | 50 |
| STRAIGHT FLUSH | 40 | 40 | 40 |
| STRAIGHT | 10 | 11 | 10 |
| FLUSH | 5 | 5 | 6 |

ALL PAYOFF ODDS ARE "TO 1"

CARD GAME

FIELD OF INVENTION

The embodiments of the present invention relate to a card game. More particularly, a card game adapted for wagering in a casino or similar gaming establishment.

BACKGROUND

As legalized gaming continues to increase in popularity, casinos and related gaming establishments seek to offer new wagering games to entertain their customers. Recently, casinos have been installing large numbers of electronic gaming machines in an effort to retain current patrons and to attract new customers. However, table games provide a different form of entertainment for customers who do not favor, or who need a break from, the often mundane electronic gaming machines. Thus, table games, although seemingly losing popularity, continue to be an integral feature to the success of any casino.

Widely offered table games include Blackjack, Craps, Roulette and Carribean Stud Poker. Unfortunately, the aforementioned table games have been in place for years and no longer exude their initial novelty. In addition, younger gaming patrons desire new and exciting games of chance. Nonetheless, it is important that new table games involve simple rules, traditional gaming indicia, and odds which both the player and the house can accept. Without the aforementioned characteristics, many new table games are likely to be short-lived. Another significant trend in table games is the opportunity to place side wagers having payouts larger than the payouts for the underlying game. For example, some Blackjack tables provide players with a side bet dependent upon the player being dealt Blackjack. If the player places the side wager and is then dealt Blackjack, the dealer causes an electronic wheel, having preestablished award amounts depicted thereon, to spin and stop such that the player wins an award above and beyond that associated with winning the underlying Blackjack game.

The embodiments of the present invention include each of the aforementioned characteristics and also provide a side wager opportunity for players. As a result, the embodiments of the present invention take advantage of the inherent features of currently successful table games.

SUMMARY

Accordingly, the embodiments of the present invention are played with a single deck of standard playing cards on a table similar to Blackjack. The use of more than a single deck is optional. The underlying game disclosed herein is generally analogous to the game of Blackjack. To that end, players attempt to achieve a higher total hand value than a dealer without going over a total hand value of thirty-three (33) as opposed to twenty-one (21). Face cards are worth ten (10), Aces are worth one (1), and the remaining numbered cards two through ten (2-10) are worth their face value. Unlike Blackjack, players are limited to taking a preestablished maximum number of cards (e.g., five).

Players first place a primary wager. The underlying game is dealt with each player and the dealer receiving two initial cards. The dealer receives one face up card and one face down card while the players ideally receive both cards face up. However, the players may receive both cards face down or one face up and one face down. The dealing pattern for the players can take any form desired by the casino operating the game. The initial two cards are dealt in a clockwise fashion starting with a first player to the dealer's most left position with each player and the dealer receiving one card at a time until all have two cards. Thereafter, the first player is engaged by the dealer and plays out the hand by surrendering, hitting, standing or doubling-down. Should the player's total hand value exceed thirty-three (33), the player loses the primary wager. Each successive player is then engaged in a clockwise fashion until each player has completed his or her hand.

Then the dealer completes his or her hand. The dealer must hit any hand value less than twenty-six (26). The dealer must hit his hand as many times as necessary to achieve a total hand value of at least twenty-six (26). The dealer may not take any cards subsequent to achieving a total hand value of twenty-six (26). Once all hands have been completed, the dealer determines which players have won and lost the primary wagers and pays the winners and collects all losing primary wagers. Winning primary wagers are paid even money. Players holding total hand values of exactly thirty-three (33) are paid 3 to 2 on their primary wager.

To add to the excitement level of the game and to entice players to play, the underlying game may also incorporate a side wager based on the initial three cards received during play of the underlying game. In one embodiment, the side wager includes a payout for a three card flush, three card straight, three card straight flush, and three of a kind. The payouts associated with receiving one of the preestablished three card hands are more attractive than the even money odds paid on a winning primary wager. For example, a three card straight may pay 10 to 1 and three of a kind may pay 50 to 1. The larger side wager odds tend to entice players to participate in the optional side wager as a matter of course when playing the underlying game.

The surrender option noted above allows players to surrender one-half of their primary wager immediately after the player has received his or her initial two cards in return for ending that particular play of the underlying game. The surrender option is typically used when a player determines that the value of the initial two cards prevents, or reduces the likelihood of, the formation of a favorable hand. Thus, the player may surrender one-half of the primary wager rather than risking the entire primary wager. Should the player surrender the primary wager with a side wager in place, possible winning side wager hands are resolved independently. Therefore, in the event the two cards surrendered can possibly form a winning side wager hand, the dealer deals a third and final card to evaluate the outcome of the side wager. In the event the two cards held during a surrender cannot possibly result in a winning side wager, the two cards and the side wager are collected by the dealer and the dealer engages the next player.

Players may also double down after the initial two, three or four cards. Doubling-down allows players to double their primary wager in return for receiving a single card (i.e., one hit). As explained later, doubling-down is a very successful option under certain favorable conditions.

In a partially electronic embodiment of the present invention, the dealer uses a keypad located on, or adjacent to, the game table to enter each player's total hand value. The keypad is in communication with a display device which displays the total hand value of each player and the dealer. This partially electronic embodiment eliminates the need for the dealer to re-count each player's total hand value as the dealer engages each player in a clockwise fashion. This embodiment is best suited for games requiring each player to receive all cards face up so that the dealer immediately knows the player's total hand value and may enter the same prior to engaging the next player. The display device is viewable by all players and further adds to the excitement level of the game.

The player's total hand value can also be indicated by a simple marker. For example, a marker similar in size and shape to a wagering chip or token can have player hand values depicted thereon. The marker system, like the electronic display, ensures that the players and the dealer know each hand value at the table.

The embodiments of the present invention may also be facilitated by an electronic gaming machine. The electronic gaming machine eliminates the need for a dealer and is more likely to attract players with little knowledge of the game. In other words, players feel less threatened to play and learn a new game in a completely electronic format. Thereafter, once the player has developed an understanding of the game, the player is more confident and therefore more likely to play the game at a table offering a live version.

Although several embodiments of the present invention have been disclosed, those embodiments and other features, variations and embodiments of the present invention are set forth hereinafter in greater detail.

DETAILED DESCRIPTION

Figure 1:
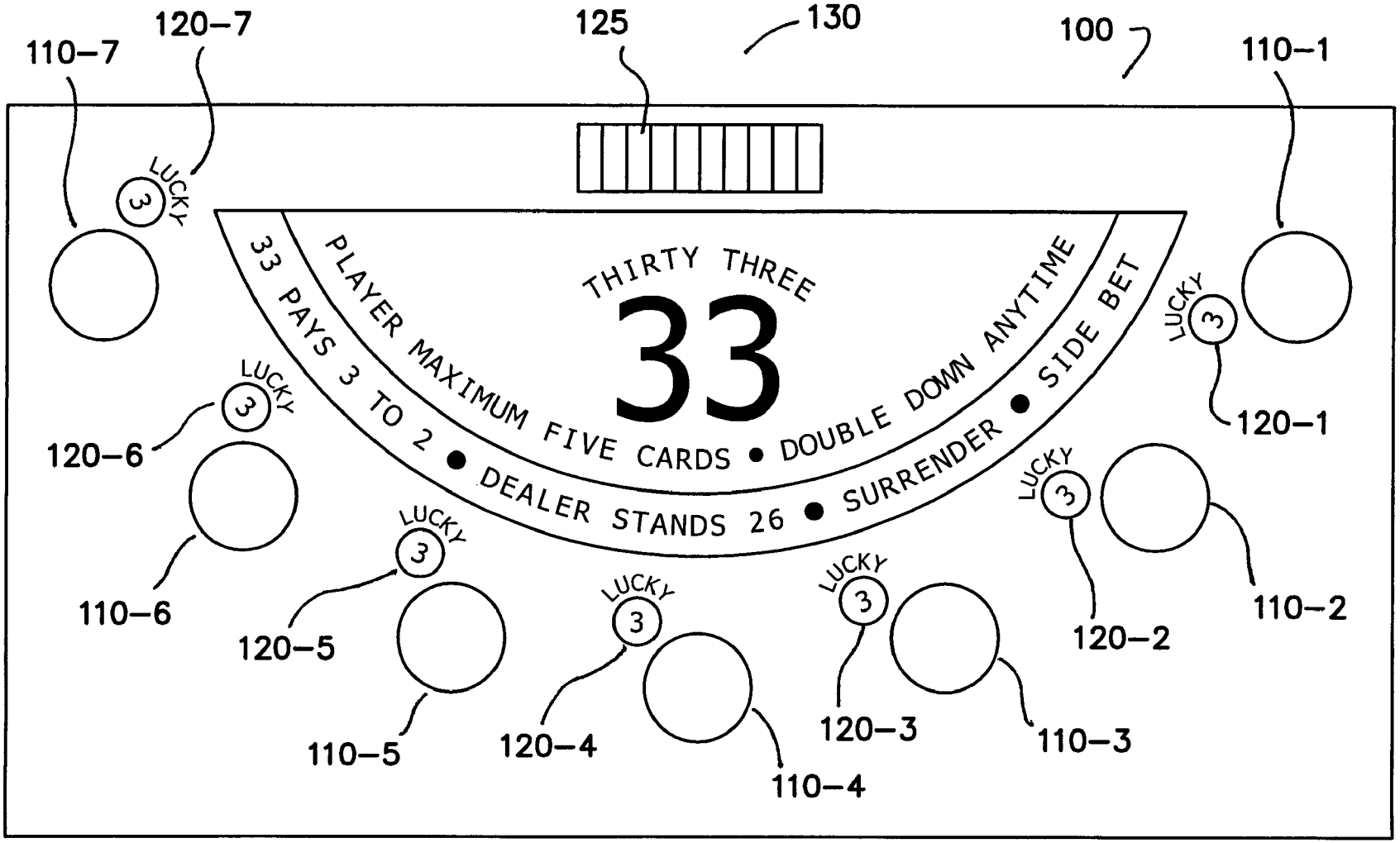
FIG. 1 illustrates a table layout for practicing the embodiments of the present invention.

As shown in FIG. 1, a table layout, generally denoted as reference numeral 100, has the overall appearance of a conventional Blackjack table. Seven player positions correspond to seven primary wager areas 110-1 through 110-7. Also incorporated on the layout 100 are seven side wager areas 120-1 through 120-7. A chip rack 125 for holding chips to pay winning wagers and to maintain collected losing wagers is integrated adjacent a dealer area 130.

While not shown, it is contemplated that a table incorporating the layout 100 may support a card shuffler or card shoe for increasing the speed at which the embodiments of the present invention may be played. Also, while not shown on the layout 100, it is contemplated that a pay table associated with a side wager may be imprinted directly on the layout 100 or may be displayed in any suitable format on, or near, the table.

Figures 2, 3:
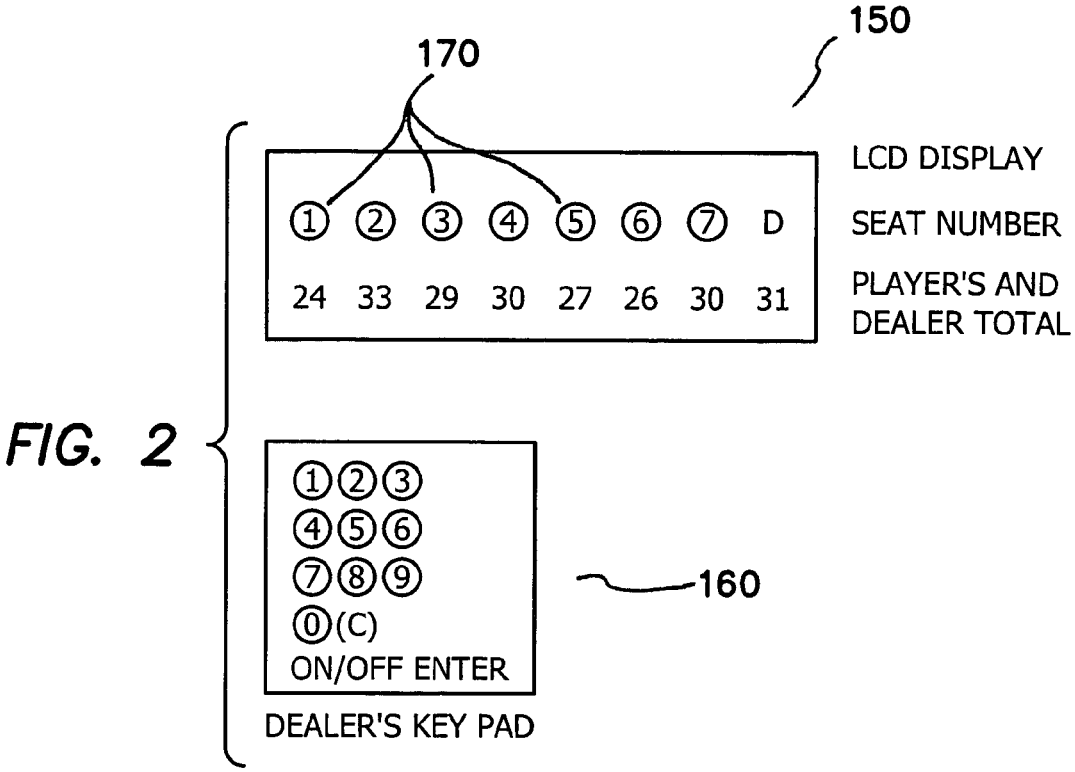
FIG. 2 illustrates a display device and keypad for use with a partially electronic embodiment of the present invention.
FIG. 3 illustrates a pay table depicting alternative payout schedules associated with a side wager of a first embodiment of the present invention.

FIG. 2 illustrates a display device 150 in electrical communication with a keypad 160. The display device 150 may be any type of display, such as a liquid crystal display (LCD), light emitting diode (LED) display or video display for displaying numbers and text inputted by means of the keypad 160. The display device 150 and keypad 160 use a conventional power outlet and electrical cord for receiving power to operate. The display 150 comprises eight (8) sections for displaying each player's total hand value and the dealer's total hand value. In practice, the dealer inputs, using the keypad 160, each player's total hand value which is then communicated to the display 150 so that the total hand value is displayed in a fashion to identify the total hand value of each player by seat or position number 170.

The player's total hand value can also be indicated by a simple marker. For example, a marker similar in size and shape to a wagering chip or token can have player hand values depicted thereon. In such an arrangement, the dealer utilizes multiple sets of markers depicting each possible hand value. Each set may be colored differently to correspond to different players. Thus, if a first player's hand value is 25, the dealer places a red chip depicting 25 thereon in proximity to the first player. Then, if a second player's hand value is 30, the dealer places a green chip depicting 30 thereon in proximity to the second player. It is contemplated that the dealer will also mark his or her own hand value. The marker system, like the electronic display, ensures that the players and the dealer are aware of each hand value at the table.

Although up to seven players may participate at a table offering the embodiments of the present invention, the description hereinafter will assume, by way of example, that two players are playing the game. Each player initially places a wager in one of the primary wager areas 110-1 through 110-7 corresponding to that player's location. Also, each player, if desired, places a wager in a corresponding side wager area 120-1 through 120-7. The permissible amounts of the primary and side wager will be determined by the casino offering the game. For example, a casino may allow players to place primary wagers ranging from $10 to $500 and side wagers ranging from $1 to $25. Once the primary and side wagers are placed, the dealer deals the players two cards face up and the dealer two cards with one card face down and one card face up. The pattern of the deal occurs one card at a time to each player and then the dealer in a clockwise fashion until each player and the dealer has two cards.

The dealer then engages a first player positioned to the dealer's most left position. At this point, the player may hit, stand, double-down or surrender as specifically described below.

Hitting requires that the player elect to receive one or more cards to improve the total hand value. The player may take a maximum of three hits resulting in a maximum player hand of five cards. In a first embodiment, all player cards are received face up. Alternatively, other dealing patterns may be used. If the player's total hand value exceeds thirty-three (33) (i.e., the player busts), the primary wager is lost and immediately collected by the dealer.

Standing requires that the player elect to hold the cards dealt and declines any additional cards. Upon receiving the initial two cards, the player will not stand since there is no chance that a third card will exceed the game's maximum total hand value of thirty-three (33). Thus, standing after the initial two cards is not a practical choice. However, after at least three cards have been dealt to the player, standing is a definite option. For example, if the player's initial three cards are face cards, which pursuant to the scoring system comprise a total hand value of thirty (30), the player will likely stand since the odds are that a fourth card will cause the player's total hand value to exceed thirty-three (33) thereby resulting in a losing outcome.

Doubling-down allows the player to double his primary wager in return for a single card (i.e., one hit). The player may double down after receiving the initial two, three or four cards. Doubling-down is best utilized when the player has a hand value that will not exceed thirty-three (33)

regardless of the next card's value. In addition, since a standard deck of 52 cards comprises sixteen cards having a value of ten (e.g. (4) Tens, (4) Jacks, (4) Queens and (4) Kings), doubling-down is also best-suited for situations when the player's hand value is within approximately ten to thirteen of thirty-three (33). Therefore, doubling-down is a sound option for players holding hands having values between approximately twenty (20) and twenty-three (23). Often times the casino offering the game may elect to permit doubling-down only on a predetermined range of hand values.

Surrendering is an option that permits players to surrender immediately after receiving their initial two cards. The player surrenders one-half of the primary wager and takes back the other one-half ending the play of the underlying game. Surrendering permits players to discard a partial hand that has a reduced likelihood of winning the primary wager. For example, should a player receive two Aces totaling two, the player may elect to surrender because the odds of receiving three consecutive high cards to significantly improve the hand value are not favorable. Alternatively, surrendering can also be permitted after three or more cards are dealt.

Once the dealer has engaged each player in a clockwise fashion from left to right, the dealer plays his or her hand. First, the dealer reveals the face down card. Then the dealer takes cards (i.e., hits his or her hand) until the dealer's total hand value is twenty-six (26) or more. Unlike the players, the dealer is not limited to taking a predetermined number of cards. Once the dealer's hand total is twenty-six (26) or more, the dealer is prohibited from taking any additional cards. Then the dealer resolves the primary wagers. All ties between the dealer and a player result in a push so that the player neither wins nor loses the primary wager. If the dealer has busted, all non-busting players win their primary wager. Otherwise, the dealer's total hand value is compared to each player's total hand value to determine winning and losing primary wagers. Winning primary wagers are paid even money and players holding total hand values of exactly thirty-three (33) are paid 3 to 2 on their primary wager.

An optional side wager provides players with a chance at a greater payout than that associated with the primary wager. Side wager areas 120-1 through 120-7 are imprinted on the table layout 100 adjacent each primary wager area 110-1 through 110-7. The side wager is based on the initial three cards received by each participating player. As shown in FIG. 3, side wager pay tables comprise payouts for flushes, straights, straight flushes, and threes of a kind. The maximum payout is provided to a player that receives three initial cards each having a value of three (i.e., three 3s). While three 3s have been chosen to correspond to the maximum payout, since the odds associated with receiving any three of a kind are identical, any three of a kind can be chosen to correspond to the maximum payout. The alternative pay tables shown in FIG. 3 illustrate differing possible payout schemes.

The side wagers are resolved after the first three cards are dealt to the player. If the player has a winning side wager, the player is paid. If the first three cards do not result in a winning side wager, the dealer collects the player's side wager and continues dealing the player's hand. If the participating player elects to surrender his or her primary wager and the player's two cards can possibly result in a winning side wager outcome, the dealer moves the two cards near the side wager area and deals a third card. The side wager is then resolved according to the associated pay table. When the two cards cannot possibly result in a winning side wager outcome, the side wager is lost and immediately collected by the dealer.

Figure 4:
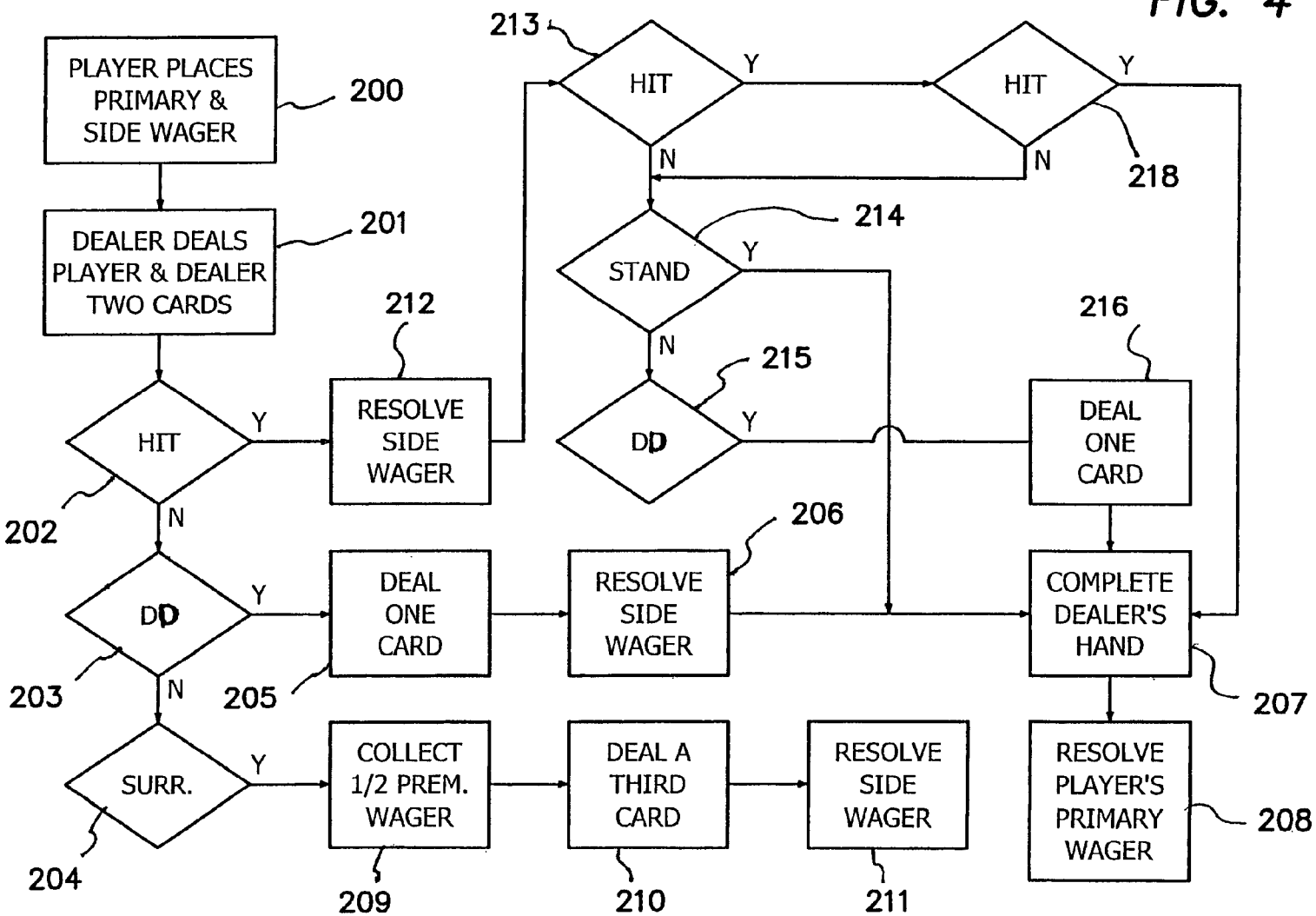
FIG. 4 illustrates a flow chart detailing a sample play of one embodiment of the present invention.

FIG. 4 illustrates a flow chart detailing a sample play of one embodiment of the present invention. Although seven players may play the embodiments of the present invention at once, for simplicity, the flowchart is based on a single player. At step 200, the player places a primary wager and a side wager. At step 201, the dealer deals the player two cards and the dealer two cards. The dealer's cards are dealt one face up and one face down. Thereafter, the dealer engages the player and the player, at steps 202, 203 and 204 elects to hit, double-down or surrender, respectively. Should the player elect to double-down at step 203, the dealer deals the player a third and final card at step 205. Then, at step 206, the dealer resolves the player's side wager. Then, at step 207, the dealer completes the dealer's hand and resolves the player's primary wager at step 208. If the player surrenders at step 204, the dealer collects one-half of the player's primary wager at step 209 and at step 210 deals the player a third card. At step 211, the dealer resolves the player's side wager.

If the player elects to take a hit at step 202, the dealer resolves the player's side wager at step 212. Now, the player may again elect to hit, stand or double-down at steps 213, 214 and 215, respectively. If the player elects to stand at step 214, at step 207, the dealer completes the dealer's hand and, at step 208, the dealer resolves the player's primary wager. If the player elects to double-down at step 215 the dealer deals a fourth and final card to the player at step 216. Thereafter, at step 207, the dealer completes the dealer's hand and, at step 208, the dealer resolves the player's primary wager.

If the player elects to take a hit at step 213, the player may again hit, stand or double-down at steps 218, 214 and 215, respectively. The player may elect to take a final card at step 218. Thereafter, at step 207, the dealer completes the dealer's hand and, at step 208, the dealer resolves the player's primary wager.

Figure 5:
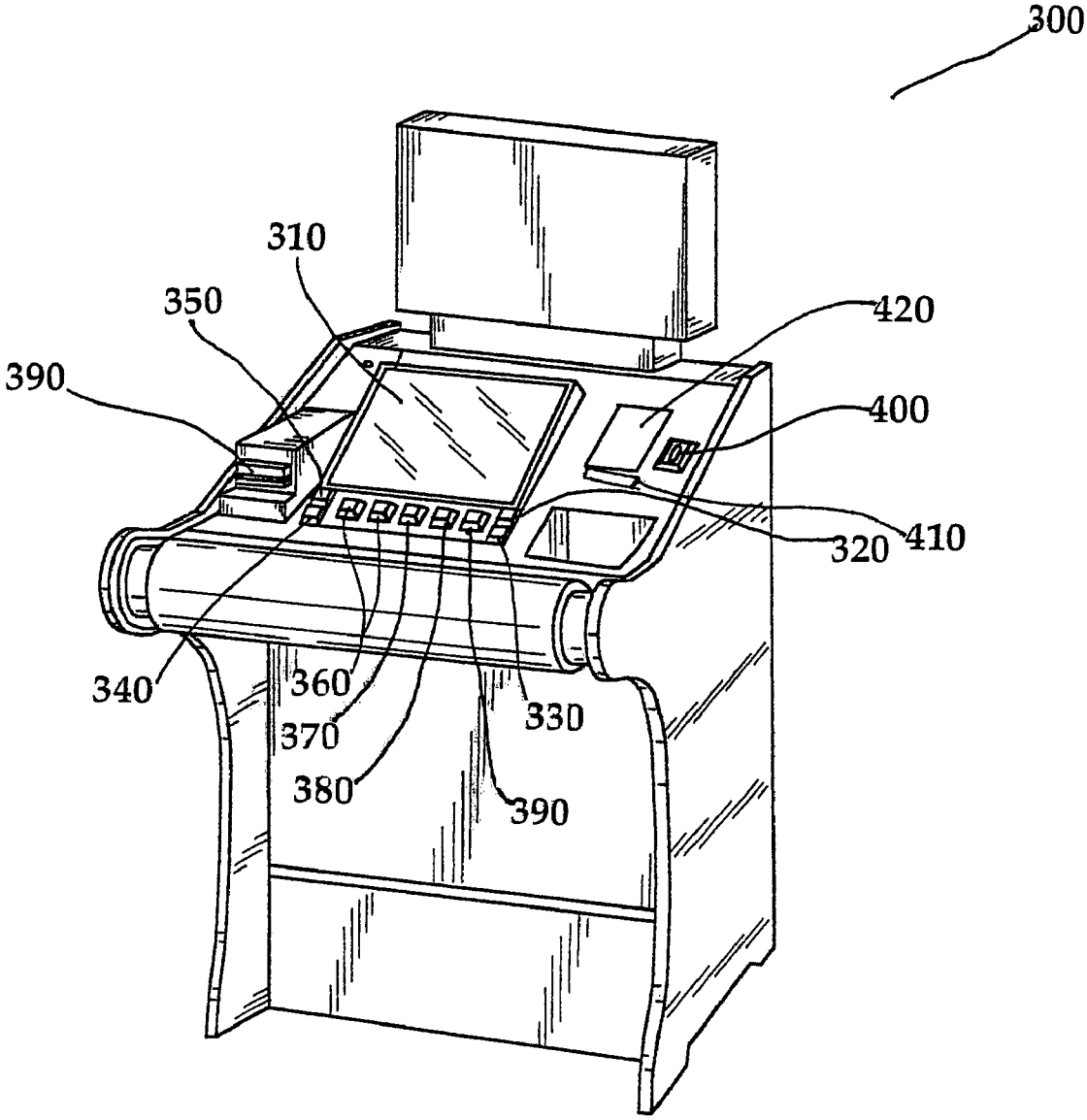
FIG. 5 illustrates an electronic gaming machine for facilitating a completely electronic version of the embodiments of the present invention.

FIG. 5 illustrates an electronic gaming machine, generally designated as reference numeral 300, of the type that may be used to implement the embodiments of the present invention in an electronic format. The external features of the gaming machine 300 include a display 310, primary wager selection button 320, a side wager selection button 330, a wager button 340, a card selection button 350, a stand button 360, a double down button 370, a surrender button 380, a card reader 390, a coin slot 400, a bill reader 410 and a credit display 420. While not shown, the gaming machine can also incorporate a ticket reader and printer for facilitating cashless play.

The operation of the gaming machine 300 is controlled by a microprocessor that communicates with an internal memory device, a display device and external interfaces (e.g., player buttons) of the machine 300. The microprocessor also incorporates, or communicates with, a random number generator which ensures the randomness of the cards dealt during the play of the electronic embodiment. Since the technology for controlling and operating gaming machines is well known to those skilled in the art, the subtle details are not described herein.

In an electronic format the game may proceed as described hereinafter. A player first inputs a wager by using the coin slot 400, bill reader 410 or the ticket reader. The wager can either be in the form of a single denomination wager (e.g., $5) or the player may insert a larger amount of money which the machine 300 displays on the credit display 420 so that the player can play on registered credit. On credit, the player first depresses the primary wager selection button 320 to select the primary wager and then uses the wager button 340 to input the amount of the primary wager. Then, if desired, the player depresses the side wager selection button 330 and then uses the wager button 340 to input the amount of the side wager. Once the wagers and corresponding amounts of the wagers have been input, the processor causes the player to receive two cards face up and the simulated dealer to receive two cards with one card face up and one card face down. Then, the player inputs his desired instructions by using the card selection button 350, the stand button 360, the double down button 370 or the surrender button 380. The machine processor is preprogrammed to facilitate any instruction input by the player. Moreover, based on the outcome of the game, the processor causes the player wagers to be resolved and the player to be paid according to a preestablished pay table stored in a memory device of the gaming machine 300. The payouts can be delivered in coins or may simply be added to the credit total of the player as displayed on the credit display 420.

In an alternative embodiment, the machine 300 includes a touchscreen display which prompts the player to select the desired wagers, the amounts of the wagers and any instructions (e.g. hit, stand, surrender, double-down). The touchscreen display eliminates the necessity of many of the gaming machine buttons described above thereby simplifying play of the game.

Obviously, many modifications and variations can be effected without departing from the spirit of the invention disclosed herein. It is therefore intended that the scope of the invention be determined solely by the claims appended hereto.

I claim:

1. A wagering game for one or more players comprising:
one or more decks of playing cards;
a gaming table having a layout depicting a player primary wager area and a player side wager area;
a primary wager associated with said primary wager area, said primary wager dependent upon a value of a player's hand exceeding a value of a dealer's hand but not a maximum value of thirty-three said player's hand comprising at least three cards, wherein each player and a dealer must play all cards dealt; and
a side wager associated with said side wager area, said side wager dependent upon a poker ranking defined by each of three first cards dealt to a player wherein each player is dealt three or more cards.

2. The wagering game of claim 1 wherein said one or more players may draw a maximum of five cards.

3. The wagering game of claim 1 wherein the poker ranking is defined by a player's first three cards.

4. The wagering game of claim 3 wherein winning poker rankings are selected from the group consisting of flushes, straights, straight flushes, and threes of a kind.

5. The wagering game of claim 1 wherein said dealer must draw a card as long as the dealer's cards have a value of twenty-five or less.

6. The wagering game of claim 1 wherein said dealer may no longer draw cards if the dealer's cards have a value of twenty-six or more.

7. The wagering game of claim 1 further comprising a display device for displaying the value of each player hand and the dealer hand.

8. The wagering game of claim 7 wherein said dealer inputs the value of each player hand and the dealer hand via a dealer interface in communication with the display device.

9. The wagering game of claim 1 further comprising means for visually indicating the value of each player hand and the dealer hand.

10. A method of playing a wagering game comprising:
offering one or more players a primary wager and a side wager;
dealing one or more players and a dealer three or more playing cards, wherein each of said players and said dealer must play all cards dealt;
allowing said players to draw one or more cards;
allowing said dealer to draw cards until a value of said dealer's cards exceeds a preestablished minimum value;
resolving each player's side wager wherein said side wager is dependent upon a poker ranking defined by each of three first cards dealt to a player wherein each player is dealt three or more cards; and
resolving each players primary wager wherein said primary wager is dependent upon a value of each player's hand exceeding a value of a dealer's hand wherein a total value of thirty-four or more is deemed a bust.

11. The method of claim 10 wherein said preestablished minimum value is twenty-five.

12. The method of claim 10 wherein said poker rankings are defined by a player's first three cards.

13. The method of claim 10 further comprising said dealer calculating a value of each player's hand and the dealer's hand and causing the values to be electronically displayed.

14. The method of claim 13 wherein the value of each player's hand and the dealer's hand is input by the dealer via a dealer interface in communication with the display device.

15. The method of claim 10 further comprising said dealer calculating a value of each player's hand and the dealer's hand and causing the values to be identified on or near a table layout.

16. A gaming machine for facilitating a wagering game comprising:
means for accepting a player primary wager and side wager;
a processor in communication with a random number generator and display device, said processor for causing said display device to display three or more randomly generated player cards and three or more randomly generated dealer cards;
selection means for said player to draw up to five cards which are each displayed on said display device, wherein said player must play all cards dealt to said player; and
said processor further for causing said display device to display dealer cards until a value of the dealer's cards exceeds a preestablished dealer minimum value, said processor further for resolving said side wager wherein said side wager is dependent upon a poker ranking defined by each of three first cards dealt to a player wherein each player is dealt three or more cards, said processor further for resolving said primary wager wherein said primary wager is dependent upon a value of a player's hand exceeding a value of a dealer's hand wherein a total value of thirty-four or more is deemed a bust.

17. The gaming machine of claim 16 wherein a player may use said selection means to draw a maximum of five cards.

18. The gaming machine of claim 16 wherein a player loses the primary wager if the value of the player's hand exceeds a maximum value.

19. The gaming machine of claim 16 wherein the poker ranking is defined by a player's first three cards.

20. The gaming machine of claim 16 wherein said processor further for causing said random number generator to select dealer cards and said display device to display dealer cards until a value of the dealer's cards exceeds twenty-five.

21. A wagering game for one or more players comprising:

one or more decks of playing cards;

a gaming table having a layout depicting a player primary wager area and a player side wager area;

a primary wager associated with the primary wager area, the primary wager dependent upon a value of a player's hand exceeding a value of a dealer's hand, said player's hand comprising at least three cards, wherein each player and a dealer do not discard any dealt cards;

a side wager associated with the side wager area, the side wager dependent upon a poker ranking defined by each of three first cards dealt to a player wherein each player is dealt three or more cards; and the primary wager being lost if either the value of the player's hand exceeds thirty-three or the value of the dealer's hand exceeds the value of the player's hand with neither the value of the player's hand or the value of the dealer's hand exceeding thirty-three, the primary wager being won if either the value of the player's hand exceeds the value of the dealer's hand with neither the value of the player's hand or the value of the dealer's hand exceeding thirty-three or the value of the dealer's hand exceeds thirty-three and the value of the player's hand does not exceed thirty-three and said side wager being won if said poker ranking is a straight, flush, straight flush or three of a kind.

22. A method of playing a wagering game comprising:

offering a primary wager and a side wager;

dealing one or more players and a dealer three or more playing cards, wherein each of said players and said dealer do not discard any dealt cards;

allowing the players to draw up to five total cards;

allowing the dealer to draw cards until a value of the dealer's cards exceeds a preestablished minimum value;

resolving each player's side wager wherein the side wager is dependent upon a poker ranking defined by each player's first three cards, the side wager being won when the poker ranking is either a straight, a flush, a straight flush or three of a kind; and resolving the primary wager wherein the primary wager is lost if either the value of the player's hand exceeds thirty-three or the value of the dealer's hand exceeds the value of the player's hand with neither the value of the player's hand or the value of the dealer's hand exceeding thirty-three, the primary wager is won if either the value of the player's hand exceeds the value of the dealer's hand with neither the value of the player's hand or the value of the dealer's hand exceeding thirty-three or the value of the dealer's hand exceeds thirty-three and the value of the player's hand does not exceed thirty-three.

* * * * *